US009777499B2

(12) United States Patent
Sung et al.

(10) Patent No.: US 9,777,499 B2
(45) Date of Patent: Oct. 3, 2017

(54) PRECAST SEGMENT, STACKING STRUCTURE AND ENERGY DISSIPATION COLUMN THEREOF

(71) Applicant: National Applied Research Laboratories, Taipei (TW)

(72) Inventors: Yu-Chi Sung, Taipei (TW); Kuo-Chun Chang, Taipei (TW); Kuan-Chen Lin, Taipei (TW); Hsiao-Hui Hung, Taipei (TW); Chi-Rung Jiang, Taipei (TW); Ming-Chun Lai, Taipei (TW)

(73) Assignee: National Applied Research Laboratories, Taipei (TW)

( * ) Notice: Subject to any disclaimer, the term of this patent is extended or adjusted under 35 U.S.C. 154(b) by 0 days.

(21) Appl. No.: 14/740,817

(22) Filed: Jun. 16, 2015

(65) Prior Publication Data

US 2016/0265212 A1 Sep. 15, 2016

(30) Foreign Application Priority Data

Mar. 13, 2015 (TW) ..... 104107995 A

(51) Int. Cl.
*E04H 9/02* (2006.01)
*E04C 3/22* (2006.01)
(Continued)

(52) U.S. Cl.
CPC ..... *E04H 9/025* (2013.01); *E01D 19/02* (2013.01); *E04C 3/22* (2013.01); *E04C 3/34* (2013.01); *E04C 5/0645* (2013.01); *E04C 5/08* (2013.01)

(58) Field of Classification Search
CPC ... E04B 1/30; E04B 1/043; E04B 1/98; E04C 3/36; E04H 9/025
See application file for complete search history.

(56) References Cited

U.S. PATENT DOCUMENTS 2,241,169 A * 5/1941 Yokes ..... E04B 1/12 52/223.7
2,929,236 A * 3/1960 Steward ..... E04L 31/06 52/223.3

(Continued)

FOREIGN PATENT DOCUMENTS

CN 203668815 U * 6/2014
CN 203961051 U * 11/2014

(Continued)

*Primary Examiner* — Jeanette E Chapman
(74) *Attorney, Agent, or Firm* — Muncy, Geissler, Olds & Lowe, P.C.

(57) ABSTRACT

A precast segment suitable for block-stacking concept is disclosed. The precast segment includes a first surface, an opposite second surface, plural through holes, and plural male-female connecting sets. The through holes extend from the first surface and toward the second surface to communicate between the first surface and the second surface. Each male-female connecting set includes a shear key and a joint hole, wherein the shear key protrudes from one of the first surface and the second surface to serve as a male connecting unit, and the joint hole is formed in the other of the first surface and the second surface to serve as a female connecting unit. Accordingly, the precast segments can be block-stacked by mortise-and-tenon joints to construct a bridge pier system. Compared to the conventional construction methodology, the present invention can enhance the efficiency of segment fabrication and avoid high prestress force.

9 Claims, 9 Drawing Sheets

(51) Int. Cl.

| | |
|---|---|
| ***E04C 3/34*** | (2006.01) |
| ***E04C 5/06*** | (2006.01) |
| ***E04C 5/08*** | (2006.01) |
| ***E01D 19/02*** | (2006.01) |

(56) References Cited

U.S. PATENT DOCUMENTS 3,618,276 A * 11/1971 Sease ..... E04H 1/1205 52/173.1
4,473,985 A * 10/1984 Hunt ..... E04B 2/18 52/503
4,953,280 A * 9/1990 Kitzmiller ..... B28B 7/0029 249/11
5,615,529 A * 4/1997 Johnson ..... A01G 1/08 47/33
5,802,797 A * 9/1998 Storer-Folt ..... E04B 2/44 52/592.5
5,987,840 A * 11/1999 Leppert ..... E04B 2/08 52/592.5
6,088,987 A * 7/2000 Simmons ..... E04B 2/14 405/285
6,161,357 A * 12/2000 Altemus ..... E04B 2/18 446/124
6,588,168 B2 * 7/2003 Walters ..... E04B 2/14 52/604
8,061,095 B2 * 11/2011 Bucheger ..... E04B 2/44 52/223.7
8,096,808 B2 * 1/2012 Trotsky ..... F41J 1/08 434/11
8,464,482 B2 * 6/2013 Raynor ..... E04C 3/34 52/169.9
8,667,750 B2 * 3/2014 Speer ..... E04B 2/16 52/223.5
8,667,760 B2 * 3/2014 Drew ..... E04B 2/16 52/600
8,720,130 B2 * 5/2014 Weber ..... E04B 2/48 52/126.4
9,010,059 B2 * 4/2015 Lin ..... A63H 33/106 446/117
2003/0029119 A1 * 2/2003 Coleman ..... E04B 2/08 52/604
2004/0128936 A1 * 7/2004 Gilbert ..... E04B 2/46 52/604
2005/0252145 A1 * 11/2005 MacDonald ..... E04B 2/16 52/606
2007/0003380 A1 * 1/2007 Knudson ..... E02D 29/025 405/284
2007/0245673 A1 * 10/2007 Cerrato ..... E04B 2/18 52/607
2012/0324820 A1 * 12/2012 Drew ..... E04B 2/16 52/600
2014/0130434 A1 * 5/2014 Speer ..... E04L 32/16 52/293.2

FOREIGN PATENT DOCUMENTS

CN 203961051 U * 11/2014
JP S5948553 A 3/1984
JP H06341112 A 12/1994
JP 2003328375 11/2003

* cited by examiner

PRECAST SEGMENT, STACKING STRUCTURE AND ENERGY DISSIPATION COLUMN THEREOF

CROSS REFERENCE TO RELATED APPLICATION

This application claims the benefits of the Taiwan Patent Application Serial Number 104107995, filed on Mar. 13, 2015, the subject matter of which is incorporated herein by reference.

BACKGROUND OF THE INVENTION

1. Field of the Invention

The present invention relates to a precast segment, a stacking structure and an energy dissipation column thereof, and more particularly to a precast segment suitable for block-stacking concept, a stacking structure and an energy dissipation column thereof.

2. Description of Related Art

Full span supporting method is a widely used traditional technology for the construction of bridges, and has advantages of simple construction and no need for large-scale hoisting equipment. However, its disadvantages include time consumption, requirement for large amount of supporting materials, and larger environmental burden during construction. In recent years, due to the raising awareness of global environment protection, the issue of environmental impacts from the construction of bridges has increasingly caught people's attention. Thereby, the precast construction has been developed to reduce the environmental impacts during bridge construction.

FIG. 1 is a perspective schematic view of a conventional segmental bridge pier which is composed of several precast segments. The segments are prefabricated in a precast factory, and then transported to a work zone and erected. The conventional segmental bridge pier includes: a base 11, multiple precast segments 13, a top segment 15, multiple high-tensile steel tendons 17 and an anchor 19. Each of the high-tensile steel tendons 17 has one end anchored to the bottom of the base 11, and penetrates through the precast segments 13 and the top segment 15, followed by applying prestress force at the column top and fixing the high-tensile steel tendons 17 using the anchor 19 to finish the fabrication of the segmental bridge pier.

As shown in FIG. 1, since each segmental layer of the conventional segmental bridge pier only includes a precast segment, it is required to prefabricate various types of precast segments for construction of different bridge piers having desired shapes or dimensions, resulting in the reduction of fabrication efficiency. In particular, when the required bridge pier has a larger cross-section, the precast segments should be fabricated into a larger dimension. As a result, the large-dimension precast segments need to rely on large equipment for transporting and hoisting the segments during the bridge construction, and are unfavorable to rapid construction. Additionally, in the conventional art, post-tensioning is typically adopted for the precast segments to provide axial force that imposes friction between the neighboring segments. The prestressing can provide resistance against shear stress caused by an external force and also provide re-centering force. However, as the bridge pier bears large axial force even no external force applied thereto, it causes adverse effects on the ductility of the bridge pier and may result in excessive stress on the precast segments.

For the reasons stated above, an urgent need exists to develop a new rapid bridge construction which can enhance the fabrication efficiency of segments, reduce the environmental impact during the construction, and resolve the issue of excessive prestress.

SUMMARY OF THE INVENTION

The object of the present invention is to provide precast segments suitable for block-stacking concept. As such, the segments can be fabricated into a single type in a precast factory, and then be assembled into a segment layer of a required cross-section according to demands. The method of the present invention can obviate the drawback of the conventional construction in which segments are fabricated into various types according to the desired shape or dimension of the bridge pier. In particular, the precast segments of the present invention can be stacked by mortise-and-tenon joints so as to prevent lateral displacement and address the issue of high prestress force required for the conventional art.

To achieve the object, the present invention provides a precast segment, which includes a first surface, an opposite second surface, plural through holes, and plural male-female connecting sets. The through holes extend from the first surface and toward the second surface to communicate between the first surface and the second surface. Each male-female connecting set includes a shear key and a joint hole, wherein the shear key protrudes from one of the first surface and the second surface to serve as a male connecting unit, and the joint hole is formed in the other of the first surface and the second surface to serve as a female connecting unit.

Accordingly, the present invention can build a column having a required cross-section by the modular segments. As the segments can be fabricated into a single type in a precast factory, the efficiency of the segment fabrication can be enhanced and the manufacturing cost of steel molds can be reduced. The construction methodology proposed by the present invention can meet the demands of rapid and economic construction, and reduce the environmental impact during hoisting the segments, thereby enhancing the construction quality. Additionally, as the precast segments of the present invention each include plural shear keys and plural joint holes at two opposite surfaces thereof, respectively, the precast segments in the upper and lower segment layers can be bonded to one another by mortise-and-tenon joints. Further, the shear keys can provide resistance against the shear stress induced by external force to prevent lateral displacement of the segments and improve the seismic resistance capability of the structure.

In the present invention, the dimension and shape of the precast segment is not particularly limited as long as it can be used to construct a column by a block-stacking concept. For instance, the precast segment may have a rectangular cross-section, but is not limited thereto. Herein, the precast segment can be made of reinforced concrete (RC), and the shear keys and the joint holes also may be in RC type. That is, the precast segment can be fabricated into an integrated structure to have shear keys and joint holes of RC type. As such, the shear keys can be more consistent with the main body of the precast segment in terms of the property of integrating therewith and force bearing behavior. Alternatively, the precast segment may be provided with shear keys and joint holes of non-RC type. For instance, the precast segment can be provided with plural concave plates and convex bars at two opposite sides thereof as the joint holes and shear keys of non-RC type, respectively. The concave plates each can define an open end at the first surface of the precast segment, and extend towards the second surface with a depth. The convex bars can be directly disposed at the second surface of the precast segment, or be threadedly engaged to and protrude from the second surface of the precast segment during column construction. Further, the concave plates each can be connected to a flange plate around the open end, and shear nails can be disposed on the flange plate to enhance the fixation of the concave plates embedded in the main body of the segment. The concave plates, the flange plates, the shear nails and the convex bars are not limited to particular materials, but preferably are made of steel-based materials. For instance, in an embodiment of the present invention, steel bars are used as the shear keys, and steel concave plates are used to form the joint holes.

In the present invention, the quantity and the location of the shear keys and the joint holes are not particularly limited, and can be modified according to requirement. For instance, in an embodiment of the present invention, a precast segment having two shear keys and two joint holes is used as a block-stacking unit. However, the shear keys and the joint holes are not limited to the aspects illustrated in the embodiments of the present invention. The precast segment also may be provided with more than two shear keys and joint holes. In addition, the shear keys and the joint holes, at the two opposite sides of the precast segment, preferably are disposed corresponding to each other. Namely, the shear keys are aligned with the joint holes. Preferably, the shear keys and the joint holes have convex and concave configurations complementary to each other, respectively. As such, the precast segments of the same type can be bonded to each other by embedding the shear keys in the joint holes. In details, the joint hole preferably has a diameter adapted to fit around the peripheral edge of the shear key, and the depth of the joint hole preferably is equal to or slightly larger than the protruding height of the shear key. Accordingly, the shear keys of the precast segment can be completely embedded in the joint holes of another precast segment. Herein, the joint holes and the shear keys are not particularly limited in cross-sectional shape and may have, for example, circular, rectangular or polygonal cross-section.

In the present invention, the precast segment can be provided with through holes at the location corresponding to the shear keys. Specifically, one end of the through hole can extend through the shear key, whereas the other opposite end of the through hole can constitute the joint hole. For instance, in the aspect of using RC shear keys and joint holes, the through holes can correspond to and extend through the shear keys to permit bearing elements or prestressing elements to be disposed through the precast segments at the location of the mortise-and-tenon joints. As an alternative, the through holes of the precast segment may be formed at the location where no shear keys are disposed. That is, the through holes neither correspond to nor extend through the shear keys. For the precast segment, the quantity and the location of the through holes are not particularly limited, and can be modified according to requirement. In any case, the through holes can be provided to allow a predetermined number of bearing elements (such as continuous bar reinforcement) and prestressing elements (such as prestressing tendons) to be disposed through the precast segments erected into a column at predetermined location.

Also, the present invention can further provide a block-stacking structure of precast segments, which includes plural segmental layers stacked into a column with one precast segment of the Nth segmental layer being connected with at least two neighboring precast segments of the (N−1)th segmental layer by mortise-and-tenon joints to provide bonds between the segmental layers using plural male-female connecting sets. Herein, N is an integer of 2 or more, and each male-female connecting set includes a shear key and a joint hole. As a result, the precast segments are stacked by embedding the shear keys into the joint holes. Additionally, the block-stacking structure may be further combined with bearing elements and prestressing elements to constitute an energy dissipation column with energy dissipation and re-centering capacity. Accordingly, the present invention can further provide an energy dissipation column with a block-stacking structure, including: plural segmental layers stacked into a column with one precast segment of the Nth segmental layer being connected with at least two neighboring precast segments of the (N−1)th segmental layer by mortise-and-tenon joints to provide bonds between the segmental layers using plural male-female connecting sets, wherein N is an integer of 2 or more, each male-female connecting set includes a shear key and a joint hole, and the precast segments are stacked by embedding the shear keys in the joint holes; plural bearing elements that penetrate through the segmental layers in a stacking direction of the segmental layers; and plural prestressing elements that penetrate through the segmental layers in the stacking direction of the segmental layers. The bearing elements can provide strength and energy dissipation capacity, and the prestressing elements can provide re-centering force upon the column deformation. Only small amount of prestress force is required for the energy dissipation column owing to the provision of the shear keys for the precast segments against shear stress induced by an external force. Compared to the conventional methodology, the present invention can resolve the issue of large axial pressure loading on the column caused by excessively prestressing.

In the present invention, each segmental layer can include a plurality of the aforementioned precast segments and have a required cross-section by arrangement of the precast segments in an X-Y plane. Further, the segmental layers can be stacked in a Z direction by mortise-and-tenon joints to build a column of desired height. For instance, plural precast segments can be assembled into a segmental layer of a rectangular cross-section, and plural segmental layers can be stacked into a column by embedding the shear keys at the second surface of one precast segment into the joint holes at the first surface of another precast segment. Preferably, the upper and lower precast segments are stacked and intersect with each other to construct a hollow or solid column, thereby enhancing lateral connection between the precast segments and avoiding slip between neighboring precast segments of the segmental layer. For instance, the precast segments can be assembled into odd- and even-numbered segmental layers by two different arrangement types, respectively. That is, the segments of the odd-numbered segmental layers can be assembled into the same arrangement with one type, whereas the segments of the even-numbered segmental layers are assembled into the same arrangement with another type. Accordingly, the precast segments of the neighboring segmental layers can be stacked in an intersecting manner. Specifically, each precast segment of each upper segmental layer can be stacked on at least two neighboring precast segments of each lower segmental layer in an intersecting manner to build a secure column structure. Herein, the number and stacking height of the segmental layers, the number and arrangement type of precast segments included in each segmental layer, and the cross-sectional dimension and shape of the segmental layers are not particularly limited, and may be varied according to requirement.

In the present invention, the bearing elements and the prestressing elements are not particularly limited in quantity. A predetermined number of bearing elements and prestressing elements can be disposed according to requirement. Preferably, the bearing elements and the prestressing elements are disposed around the peripheral edge of the column structure to enhance seismic resistance capacity. The bearing elements can be continuous bar reinforcements, and more particularly be continuous bonded bar reinforcements formed by grouting so as to provide strength and energy dissipation capacity. The prestressing elements can be prestressing tendons, and more particularly be unbounded prestressing tendons with no grouting. By slight post-tensioning, the prestressing elements can provide re-centering force upon column deformation.

Accordingly, the present invention can be applied in a bridge pier system to construct a segmental bridge pier including a base, a pillar and a top segment by the aforementioned block-stacking concept. The pillar disposed between the base and the top segment can be formed by stacking a plurality of the aforementioned segmental layers. Further, bearing elements and prestressing elements can be provided to serially connect the segmental layers so as to construct a bridge pier with energy dissipation and re-centering capacity.

In summary, the present invention utilizes the block-stacking concept to propose a novel construction methodology of precast segmental bridge. By modularity of segments, the fabrication cost of steel molds can be reduced, and the segments can be fabricated more efficiently. Further, as the precast segments can be fabricated into a small scale and easy to be transported and erected, the novel methodology can shorten the time of constructing a new bridge at a work zone or renewing and repairing an existing bridge, and can be applied in the rapid construction of substructure for the temporary rescue bridge. Moreover, the precast segments of the present invention can be bonded to each other using shear keys so as to provide shear resistance, and only requires small amount of prestress force to provide re-centering capacity upon column deformation. The prestress force would cause larger axial stress only when the steel tendons are stretched due to the lateral displacement of the column. Upon the column returns to the original form, the axial stress will decrease accordingly. As a result, the present invention can address the issue in the conventional art that large prestress force imposes high axial pressure on the precast segmental bridge pier before column deformation. Accordingly, the column structure proposed by the present invention can be applied in a seismic zone for construction of a bridge pier system owing to its seismic behavior similar to traditional seismic resistant bridges and better re-centering capacity.

DETAILED DESCRIPTION OF THE PREFERRED EMBODIMENT

Hereafter, example will be provided to illustrate the embodiments of the present invention. Advantages and effects of the invention will become more apparent from the disclosure of the present invention. It should be noted that these accompanying figures are simplified and illustrative. The quantity, shape and size of components shown in the figures may be modified according to practical conditions, and the arrangement of components may be more complex. Other various aspects also may be practiced or applied in the invention, and various modifications and variations can be made without departing from the spirit of the invention based on various concepts and applications.

Figure 1:
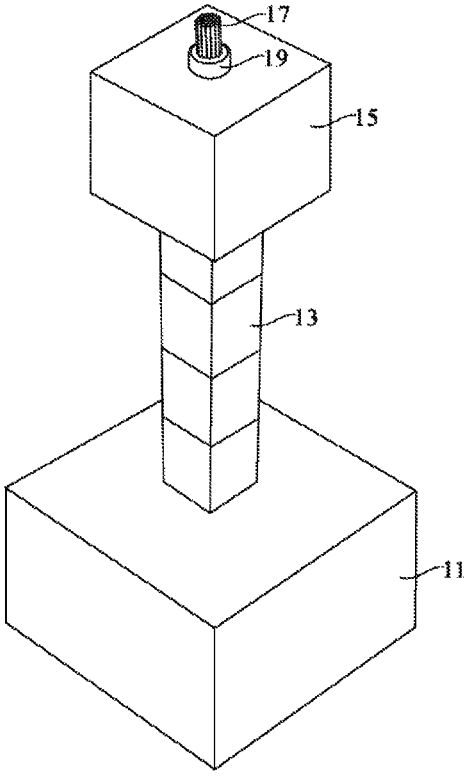
FIG. 1 (PRIOR ART)
FIG. 1 is a perspective schematic view of a conventional segmental bridge pier.
Figure 2:
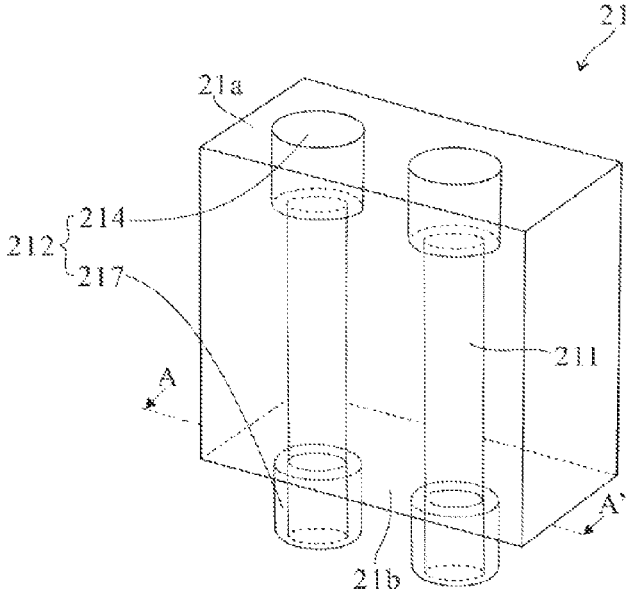
FIG. 2 is a perspective schematic view of a precast segment in accordance with the first embodiment of the present invention.
Figure 3:
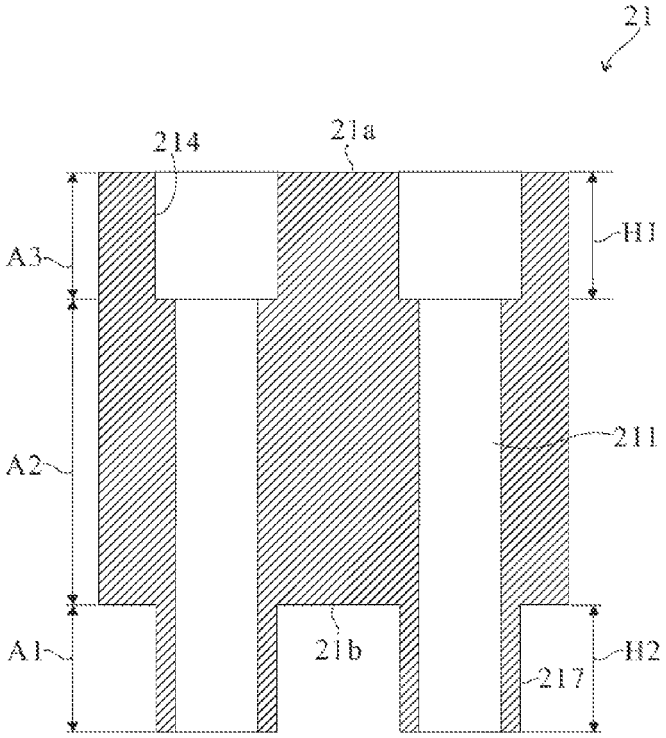
FIG. 3 is a cross-sectional view taken along line AA' in FIG. 2.

Please refer to FIGS. 2 and 3, in which FIG. 2 is a perspective schematic view of a precast segment in accordance with the first embodiment of the present invention, and FIG. 3 is a cross-sectional view taken along line AA' in FIG. 2. The precast segment 21 of this embodiment includes a first surface 21*a*, a second surface 21*b* opposite to the first surface 21*a*, plural through holes 211 and plural male-female connecting sets 212. The through holes 211 extend from the first surface 21*a* and toward the second surface 21*b* to communicate between the first surface 21*a* and the second surface 21*b*. Each male-female connecting set 212 includes a joint hole 214 and a shear key 217, wherein the joint holes 214 are formed in the first surface 21*a* to serve as female connecting units, and the shear keys 217 are disposed at and protrudes from the second surface 21*b* to serve as male connecting units. In this embodiment, the precast segment 21 is a reinforced concrete (RC) segment of an integrated structure, and the through holes 211 correspond to the shear keys 217 of RC type. In details, one end of the through hole 211 extends through the shear key 217, whereas the other opposite end of the through hole 211 constitutes the joint hole 214 at the first surface 21*a* so as to permit bearing elements or prestressing elements as mentioned below to be disposed therethrough. For the convenience of detailed description below, the region in which the through hole 211 penetrates through the shear key 217 is defined as a first sections A1, and the region in which the through hole 211 penetrates through the main body of the segment is divided into a second section A2 and a third section A3. Herein, the third section A3 of the through hole 211 is used as the joint hole 214. As shown in FIG. 3, the first section A1 and the second section A2 of the through hole 211 are smaller than the third section A3 in diameter, and the third section A3 has a diameter adapted to fit around the peripheral edge of the shear key 217 and serves as the joint hole 214. Preferably, the depth H1 of the joint hole 214 is substantially equal to the protruding height H2 of the shear key 217 from the second surface 21*b*, or the depth H1 of the joint hole 214 is slightly larger than the height H2 of the shear key 217. Accordingly, two identical precast segments can be bonded to each other by embedding the shear keys 217 completely in the joint holes 214 to provide shear resistance against vibration of the structure. In brevity, the joint holes 214 and the shear keys 217 preferably have complementary concave and convex configurations, respectively, and are closely matched with each other so as to avoid excessive slip between the precast segments caused by vibration of the structure. Additionally, the cross-sections of the joint holes 214 and the shear keys 217 are not limited to the circular shape illustrated in the figures, and may be modified to other shapes, such as square or hexagon.

Figure 4:
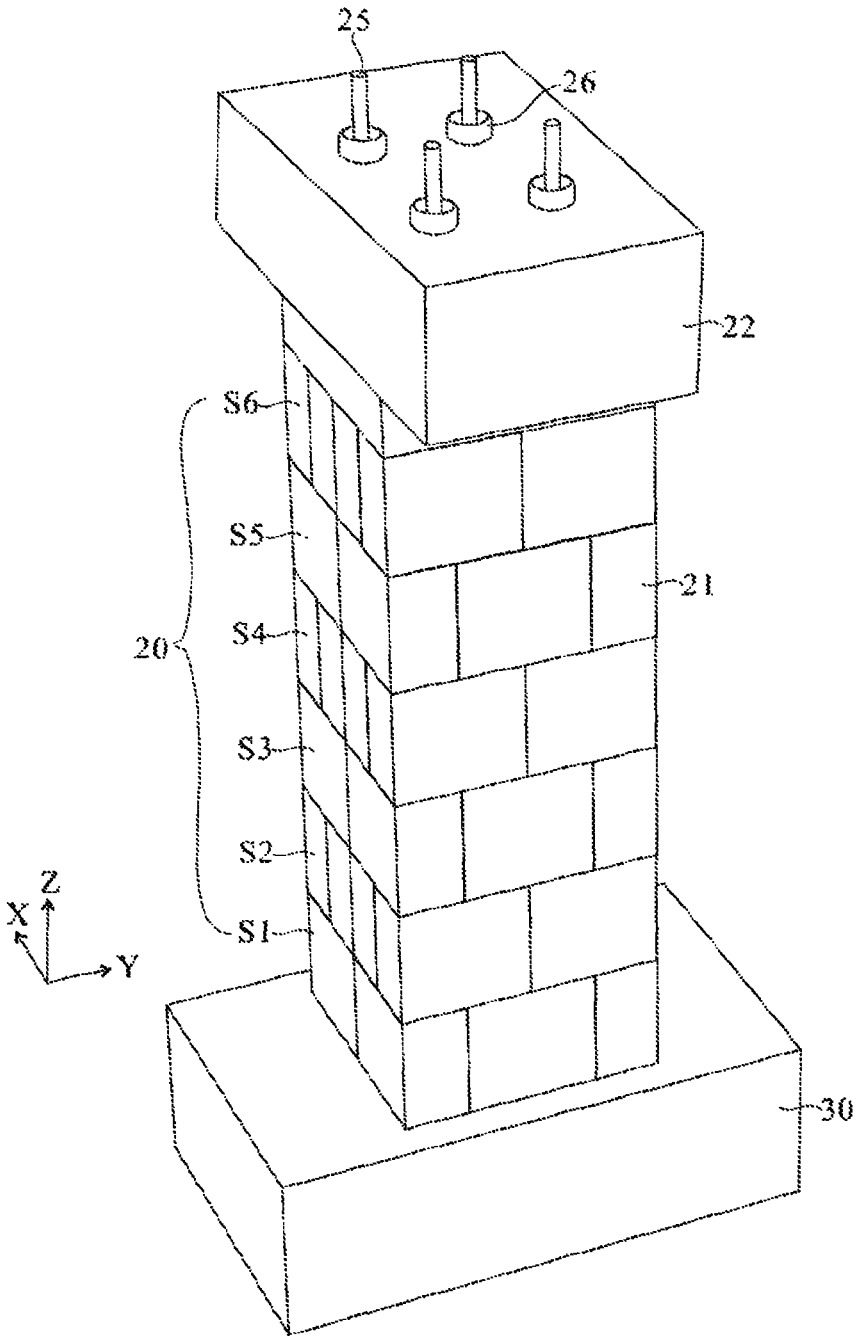
FIG. 4 is a perspective schematic view of a segmental bridge pier in accordance with the first embodiment of the present invention.
Figure 5:
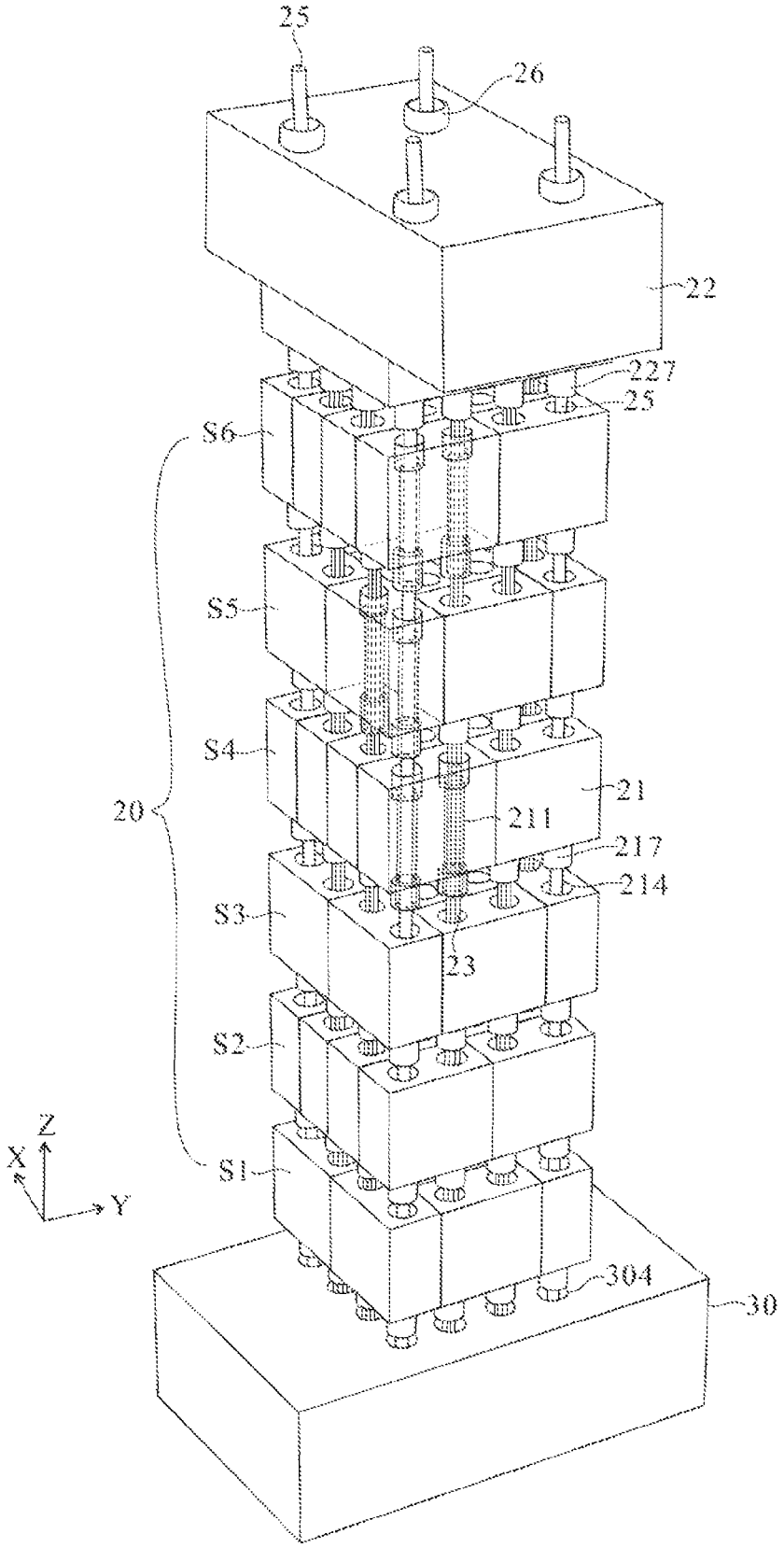
FIG. 5 is a full exploded perspective schematic view corresponding to FIG. 4.
Figure 6:
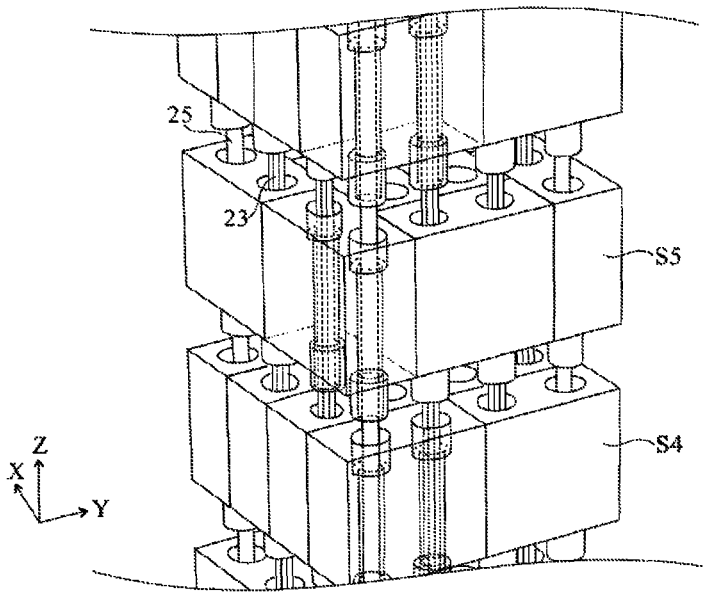
FIG. 6 is a partial exploded perspective schematic view corresponding to FIG. 4.

Attention is now directed to FIGS. 4-6. FIG. 4 is a perspective schematic view of the structure with the precast segments 21 of this embodiment and a top segment 22 stacked on a base 30. FIGS. 5 and 6 are full and partial exploded perspective schematic views corresponding to FIG. 4, respectively. In this embodiment, the first segmental layer S1, the second segmental layer S2, the third segmental layer S3, the fourth segmental layer S4, the fifth segmental layer S5 and the sixth segmental layer S6 are stacked on the base 30 in a Z direction by block-stacking concept; the bearing elements 23 and the prestressing elements 25 penetrate through the first to the sixth segmental layers S1-S6 in the Z direction to construct an energy dissipation column 20 of a solid cylindrical structure; and finally the top segment 22 is disposed on the sixth segmental layer S6 to finish the segmental bridge pier of this embodiment. The first to the sixth segmental layers S1-S6 of this embodiment consist of the precast segments 21 of FIGS. 2-3, and the top segment 22 also is provided with shear keys 227 on one surface thereof. The shear keys 227 have the same configuration as the shear keys 217 of the precast segment 21, and also are provided with through holes (not shown in the figure) to permit the bearing elements 23 and the prestressing elements 25 to be disposed therethrough. The column of six-layer structure illustrated in this embodiment is provided for explanation. The practical number of layers for the column can be modified according to requirement and is not limited thereto.

Figure 7:
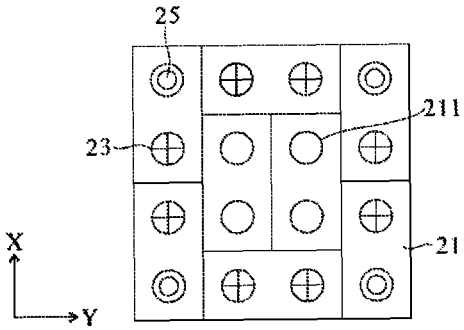
FIG. 7 is a schematic view showing an arrangement of precast segments in accordance with the first embodiment of the present invention.
Figure 8:
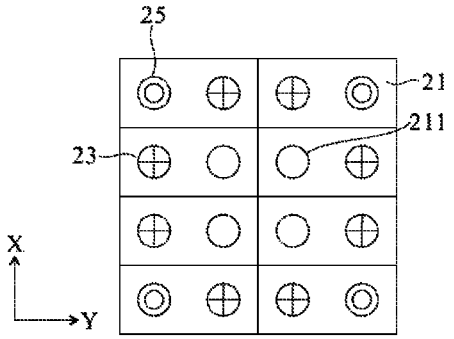
FIG. 8 is a schematic view showing another arrangement of precast segments in accordance with the first embodiment of the present invention.

As shown in FIGS. 4 and 5, the base 30 can provide support from the bottom of the energy dissipation column 20, and has a larger cross-sectional dimension than that of the first to the sixth segmental layers S1-S6. The base 30 is provided with joint holes 304 having a shape adapted to receive the shear keys 217 of the precast segment 21. As such, the shear keys 217 of the precast segment 21 can be embedded in the joint holes 304 of the base 30. Similarly, as shown in FIGS. 5 and 6, the shear keys 217 of each precast segment 21 in the second to the sixth segmental layers S2-S6 are embedded in the joint holes 214 of two neighboring precast segments 21 in the lower segmental layer so as to provide bonds between the segmental layers. Further, the shear keys 227 of the top segment 22 are embedded in the joint holes 214 of all precast segments 21 in the sixth segmental layer S6 to secure the top segment 22 on the top of the energy dissipation column 20. Accordingly, as the precast segment 21 of each upper segmental layer is disposed across the interface between two neighboring precast segments 21 of each lower segmental layer, the dislocation of the precast segments 21 in the segmental layers can be avoided. Further, please refer to FIGS. 7 and 8, in which FIG. 7 is a schematic view showing the arrangement of the precast segments 21 for the first, third and fifth segmental layers S1, S3 and S5 in the X-Y plane, and FIG. 8 is a schematic view showing the arrangement of the precast segments 21 for the second, fourth and sixth segmental layers S2, S4 and S6 in the X-Y plane. The symbol "⊕" means the through hole with the bearing elements 23 disposed therein. The symbol "◎" means the through hole with the prestressing elements 25 disposed therein. The symbol "○" means the through hole with no bearing elements 23 and no prestressing elements 25 disposed therein. As shown in FIGS. 5-8 for this embodiment, the first to sixth segmental layers S1-S6 each include eight precast segments 21, and the bearing elements 23 and the prestressing elements 25 are disposed through different through holes 211 of the outmost precast segments 21 to serially connect the first to sixth segmental layers S1-S6 in the Z direction and further penetrate through the through holes 304 of the base 30 and the shear keys 227 of the top segment 22. The bearing elements 23 are continuous bar reinforcements and more particularly are continuous bonded bar reinforcements formed by grouting so as to provide strength and energy dissipation capacity. The prestressing elements 25 are prestressing tendons provided with small amount of prestress force. One end of the prestressing elements 25 is embedded in and secured to the base 30 by prestressing anchors (not shown in the figure), whereas the other end of the prestressing elements 25 is applied with prestress force at the column top, followed by fixation of the prestressing elements 25 using the anchors 26 (as shown in FIGS. 4 and 5). As a result, the prestressing elements 25 with no grouting can provide re-centering force upon the deformation of the structure.

In this embodiment, the number and location of the shear keys, the joint holes and the through holes for each precast segment, the number of the segmental layers, the number and arrangement type of the segments included in each segmental layer, and the location of the bearing elements and the prestressing elements illustrated in FIGS. 2-8 are disclosed only for purposes of explanation, and can be varied by those skilled in the art according to actual requirement and not limited to those shown in the figures.

Embodiment 2

Figure 9:
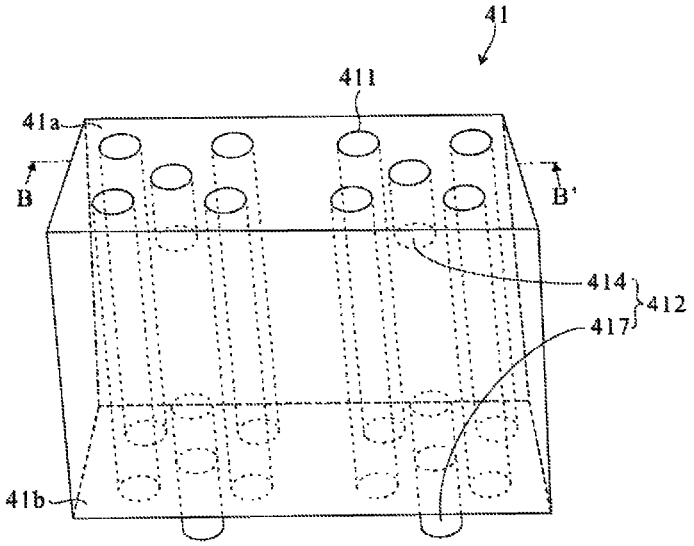
FIG. 9 is a perspective schematic view of a precast segment in accordance with the second embodiment of the present invention.

Please refer to FIG. 9, which is a perspective schematic view of a precast segment in accordance with the second embodiment of the present invention. As shown in FIG. 9, the precast segment 41 of this embodiment includes a first surface 41*a*, a second surface 41*b* opposite to the first surface 41*a*, plural through holes 411 and plural male-female connecting sets 412. Each male-female connecting set 412 includes a joint hole 414 and a shear key 417, wherein the joint holes 414 are formed in the first surface 41*a* to serve as female connecting units, and the shear keys 417 are disposed at and protrude from the second surface 41*b* to serve as male connecting units. The through holes 411 extend from the first surface 41*a* to the second surface 41*b*, and are disposed apart from the joint holes 414 and the shear keys 417 (namely, the through holes 411 do not extend through the shear keys 417). In this embodiment, the precast segment 41 is formed with joint holes 414 and shear keys 417 of non-RC type as male-female connecting sets. As another aspect of this embodiment, the precast segment 41 may be fabricated into an integrated structure to have joint holes 414 and shear keys 417 of RC type. Hereafter, the joint holes 414 and the shear keys 417 of non-RC type would be taken for detailed illustration.

Figure 10:
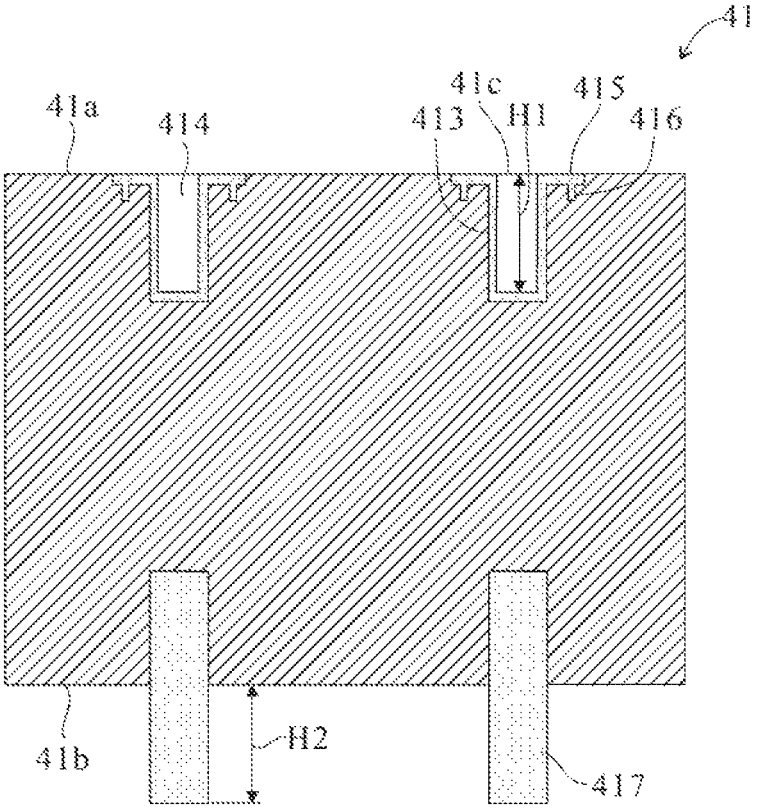
FIG. 10 is a cross-sectional view taken along line BB' in FIG. 9.

Please refer to FIG. 10, which is a cross-sectional view taken along line BB' in FIG. 9. As shown in FIG. 10, the joint holes 414 are formed by plural concave plates 413 disposed at the first surface 41*a*. The concave plates 413 each define an open end 41*c* at the first surface 41*a*, and extend from the first surface 41*a* and towards the second surface 41*b* with a depth H1 to form the joint holes 414. The shear keys 417 each protrude from the second surface 41*b* with a height H2 and have an end fixed at the main body of the segment. Further, the joint holes 414 has a diameter adapted to fit around the peripheral edge of the shear keys 417, and the depth H1 of the joint holes 414 preferably is equal to or slightly larger than the protruding height H2 of the shear keys 417 from the second surface 41*b*. Accordingly, two identical precast segments can be bonded with each other by completely embedding the shear keys 417 in the joint holes 414 to provide shear resistance against the vibration of the structure. Additionally, the concave plates 413 each are connected to a flange plate 415 around the open end 41*c* thereof, and shear nails 416 are disposed on the flange plate 415 to enhance the fixation of the concave plates 413 embedded in the RC main body of the segment. In this embodiment, the concave plates 413, the flange plates 415, the shear nails 416 and the shear keys 417 preferably are made of steel-based materials. That is, the joint holes 414 can be formed by steel concave plates, and the shear keys 417 can be steel bars. However, this is provided only for exemplary illustration and the materials are not limited thereto.

Figure 11:
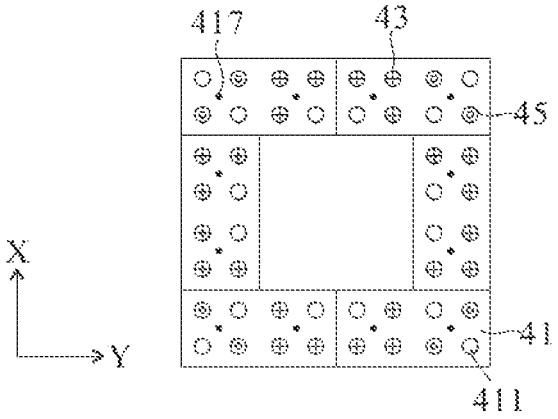
FIG. 11 is a schematic view showing an arrangement of precast segments in accordance with the second embodiment of the present invention.
Figure 12:
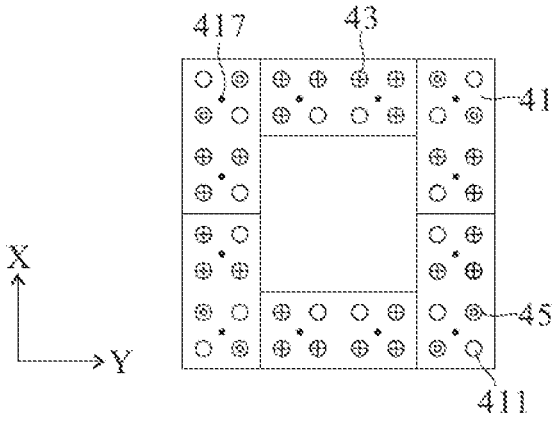
FIG. 12 is a schematic view showing another arrangement of precast segments in accordance with the second embodiment of the present invention.

Accordingly, in this embodiment, a column can be constructed from multiple segmental layers by stacking the precast segments 41 shown in FIGS. 9 and 10. Please refer to FIGS. 11 and 12, which are schematic views showing two different arrangement types of the precast segments 41 in accordance with this embodiment. The symbol "⊕" means the through hole with the bearing elements 43 disposed therein. The symbol "◎" means the through hole with the prestressing elements 45 disposed therein. The symbol "○" means the through hole with no bearing elements 43 and no prestressing elements 45 disposed therein. The symbol "●" means the shear key 417. The arrangement of the segments in the X-Y plane shown in FIG. 11 can be adopted to build the odd-numbered segmental layers, including the first, third, fifth, seventh segmental layers and so on, whereas the arrangement of the segments in the X-Y plane shown in FIG. 12 can be adopted to build the even-numbered segmental layers, including the second, fourth, sixth segmental layers and so on. Alternatively, the arrangement of the segments in the X-Y plane shown in FIG. 11 is adopted to build the even-numbered segmental layers, including the second, fourth, sixth segmental layers and so on, whereas the arrangement of the segments in the X-Y plane shown in FIG. 12 is adopted to build the odd-numbered segmental layers, including the first, third, fifth, seventh segmental layers and so on. Accordingly, the shear keys 417 of the precast segments 41 in each upper even-numbered segmental layer can be embedded in the joint holes 414 of the precast segments 41 in each lower odd-numbered segmental layer so as to construct a hollow column. As the upper and lower precast segments are stacked in an intersecting manner, the lateral connection between the precast segments can be enhanced. Further, as shown in FIGS. 11 and 12, the bearing elements 43 and the prestressing elements 45 are disposed through different through holes 411 of the precast segments 41, respectively, to serially connect all the segmental layers in the vertical direction. The bearing elements 43 can be continuous bonded bar reinforcements formed by grouting so as to provide strength and energy dissipation capacity. The prestressing elements 45 are provided with small amount of prestress force and not grouted so as to provide re-centering force upon lateral displacement of the column. In this embodiment, the number and location of the shear keys, the joint holes and the through holes for each precast segment, the number and arrangement type of the segments, and the location of the prestressing tendons and the continuous bar reinforcements illustrated in FIGS. 9-12 are disclosed only for purposes of explanation, and can be varied by those skilled in the art according to actual requirement and not limited to those shown in the figures.

Embodiment 3

Figure 13:
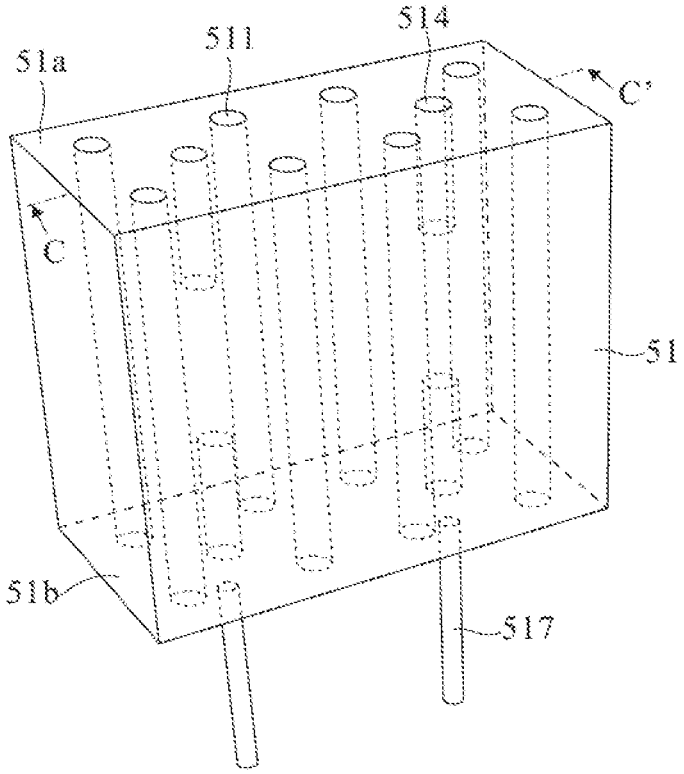
FIG. 13 is a perspective schematic view of a precast segment in accordance with the third embodiment of the present invention.
Figure 14:
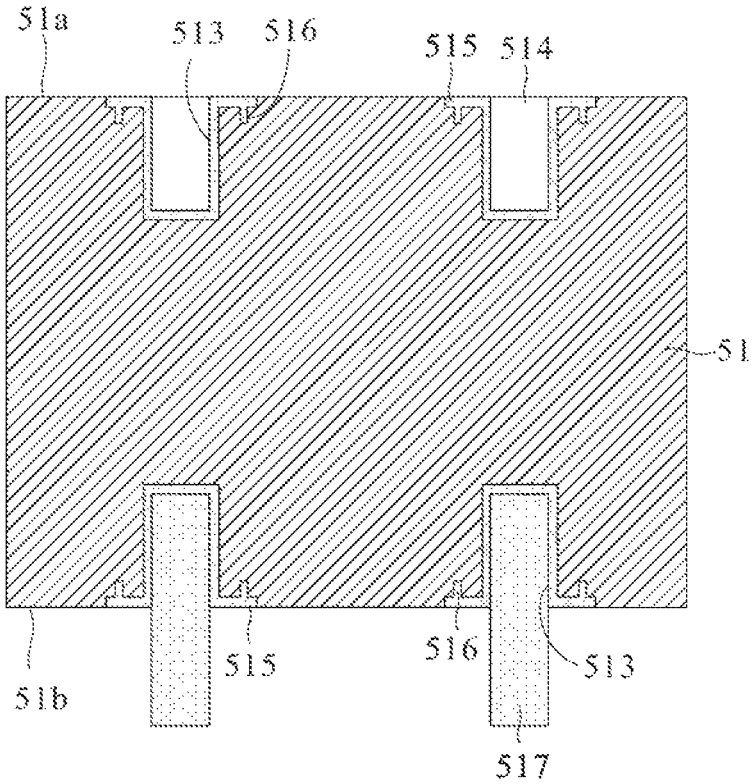
FIG. 14 is a cross-sectional view taken along line CC' in FIG. 13.

Please refer to FIGS. 13 and 14, in which FIG. 13 is a perspective schematic view of a precast segment in accordance with the third embodiment of the present invention, and FIG. 14 is a cross-sectional view taken along line CC' in FIG. 13. The precast segment 51 of this embodiment is similar to the precast segment 41 of Embodiment 2, except that the shear keys 517 are secured at the second surface 51*b* of the precast segments 51 in the upper layer during the column construction in this embodiment, followed by embedding the shear keys 517 of the upper precast segments in the joint holes of the lower precast segments (not shown in the figure).

In details, as shown in FIG. 14 for this embodiment, the first surface 51*a* and the second surface 51*b* of the precast segment 51 are provided with plural concave plates 513, respectively, and the shear keys 517 are disposed to be engaged with the concave plates 513 at the second surface 51*b* of the precast segment 51 by screw threads (not shown in the figure) during column construction. As a result, the first surface 51*a* of the precast segment 51 is provided with joint holes 514 formed by the concave plates 513, whereas the second surface 51*b* of the precast segment 51 is provided with shear keys 517 threadedly engaged with the concave plates 513. Other elements of the precast segment 51 in this embodiment, including the through holes 511, the flange plates 515 and the shear nails 516, are the same as those illustrated in Embodiment 2, and the repetitious details need not be given here.

As illustrated in the aforementioned embodiments, the present invention provides a novel rapid construction of column structure, which can be applied in a bridge pier system and also suitable to construct column structures of any building. The novel construction methodology of the present invention has advantages of modularity, easy operation, rapid construction and low impact, and meets practical demands.

The above examples are intended for illustrating the embodiments of the subject invention and the technical features thereof, but not for restricting the scope of protection of the subject invention. The scope of the subject invention is based on the claims as appended.

What is claimed is:

1. An energy dissipation column with a block-stacking structure, comprising:

plural segmental layers stacked into a column, with one precast segment of the Nth segmental layer being connected with at least two neighboring precast segments, arranged along an X direction, of the (N−1)th segmental layer, and with another segment of the Nth segmental layer being connected with at least two neighboring precast segments, arranged along a Y direction orthogonal to the X direction, of the (N−1)th segmental layer by mortise-and-tenon joints to provide bonds between the segmental layers using plural male-female connecting sets, wherein N is an integer of 2 or more, each male-female connecting set includes a shear key and a joint hole, and the precast segments are stacked by embedding the shear key in the joint hole, the segmental layers each has plural ones of the precast segments arranged along the X direction and other plural ones of the precast segments arranged along the Y direction, and the precast segments of the odd-numbered segmental layers are assembled into the same arrangement with one type, whereas the precast segments of the even-numbered segmental layers are assembled into the same arrangement with another different type;

plural bearing elements that penetrate through the segmental layers in a stacking direction of the segmental layers and are continuous bonded bar reinforcements formed by grouting and capable of providing strength and energy dissipation capacity for the column; and plural prestressing elements that penetrate through the segmental layers in the stacking direction of the segmental layers and are unbounded prestressing tendons with no grouting and are configured to provide re-centering force for the column, wherein the plural bearing elements and the plural prestressing elements are disposed around peripheral edges of the column structure, with no bearing elements and prestressing elements penetrating through a central area of the column.

2. The energy dissipation column with a block-stacking structure of claim 1, wherein the shear key and the joint hole have convex and concave configurations complementary to each other, respectively.

3. The energy dissipation column with a block-stacking structure of claim 1, wherein the segmental layers are stacked into a solid or hollow column.

4. The energy dissipation column with a block-stacking structure of claim 1, wherein each of the bearing elements is a continuous bar reinforcement.

5. The energy dissipation column with a block-stacking structure of claim 1, wherein (i) the precast segments of the segmental layers each includes a first surface, an opposite second surface, plural through holes, and the plural male-female connecting sets, (ii) the through holes extend from the first surface and toward the second surface to communicate between the first surface and the second surface, (iii) the shear key protrudes from one of the first surface and the second surface to serve as a male connecting unit, and the joint hole is formed in the other of the first surface and the second surface to serve as a female connecting unit, and (iv) the bearing elements and the prestressing elements are disposed through the through holes.

6. The energy dissipation column with a block-stacking structure of claim 5, wherein the shear key is made of reinforced concrete.

7. The energy dissipation column with a block-stacking structure of claim 6, wherein at least one of the through holes corresponds to the shear key, and has one end extending through the shear key and the other opposite end constituting the joint hole.

8. The energy dissipation column with a block-stacking structure of claim 5, wherein the shear key is a steel bar.

9. The energy dissipation column with a block-stacking structure of claim 8, wherein the joint hole is formed by a steel concave plate.

* * * * *